United States Patent [19]

Seitz

[11] Patent Number: 4,988,022

[45] Date of Patent: Jan. 29, 1991

[54] GARMENT HANGER SHOULDER GUARD AND BLANK THEREFOR

[75] Inventor: Joel Seitz, S. Hackensack, N.J.

[73] Assignee: Chesapeake Fiber Packaging Corporation, Hunt Valley, Md.

[21] Appl. No.: 190,584

[22] Filed: May 5, 1988

[51] Int. Cl.[5] ..... A47G 25/20

[52] U.S. Cl. ..... 223/98; 223/87

[58] Field of Search ..... 223/87, 98

[56] References Cited

U.S. PATENT DOCUMENTS

| | | | |
|---|---|---|---|
| 1,715,004 | 5/1929 | Johnson | 223/98 |
| 2,873,054 | 2/1959 | Zintel | 223/98 |
| 3,033,430 | 5/1962 | Zintel | 223/98 |
| 3,202,330 | 8/1965 | Hawkins | 223/98 |

*Primary Examiner*—Werner H. Schroeder
*Assistant Examiner*—Bibhu Mohanty
*Attorney, Agent, or Firm*—Lieberman, Rudolph & Nowak

[57] ABSTRACT

A card stock blank is convertible into a garment hanger shoulder guard which is storable in flat condition with no remaining assembly operations. The blank has base and top edges, a first fold line perpendicular to and extending from the base edge along a transverse line to a hole, and a second fold line extending from the top edge to the hole and making an obtuse angle with the top edge. The top edge is interrupted by a notch which communicates with the hole and has a first edge extending from the top edge to the hole and being a mirror image of the second fold line. The notch further has a second edge confronting the first edge. The blank is foldable into a flat condition with the first edge coinciding with the second fold line and material adjacent the first edge confronting material located between the second fold line and the second edge. The guard is made by affixing the confronting material to itself as by cement.

13 Claims, 4 Drawing Sheets

GARMENT HANGER SHOULDER GUARD AND BLANK THEREFOR

BACKGROUND OF THE INVENTION

This invention relates to shoulder guards for garment hangers and, more particularly, to such a shoulder guard having several advantages over the prior art, and to a blank for use in making the inventive shoulder guard.

Prior art garment shoulder guards generally do not support a large area of the shoulders of garments hung thereon and in consequence such garments tend to wrinkle fairly rapidly when hung on the prior art guards; and some even do not materially improve in this regard to the situation in which the garments are hung on wire hangers.

The assembly of prior art guards such as the "FIT-RITE DELUXE"; "FORM-IT"; "SHAPE-UP" and "CONTOUR", must typically be completed by personnel in dry cleaning establishments, prior to assembly thereof with hangers. This is because the guards, when assembled, are three-dimensioned, and are thus too bulky to be stored in large quantities required in dry cleaning establishments. The assembly of prior art guards typically requires complex folding and fastening steps (staples, tabs, etc.) and is thus a time-consuming and expensive operation at the retail level.

Accordingly, it is an important object of the invention to provide an improved garment hanger shoulder guard which will support a larger area of the shoulders of a garment hung thereon to enhance the care of the garment.

It is another important object to provide an improved garment hanger shoulder guard, which can be easily assembled at the retail level, or completely assembled in the factory, requiring no assembly operation at the retail level.

It is a further important object of the present invention to provide a completely assembled garment hanger shoulder guard which is foldable prior to use into a two-dimensional flat condition for storage in a stacked supply, ready for instantaneous use.

It is a still further object of the invention to provide a guard which is economical to manufacture, and does not cost appreciably more than prior art guards.

It is an additional object of the invention to provide a blank for use in manufacturing a guard which achieves the foregoing objects and advantages.

SUMMARY OF THE INVENTION

The inventive card stock blank is convertible into the inventive garment holder shoulder guard which is storable in flat condition with no remaining assembly operations.

The blank comprises a parallel base and top edges, a first fold line substantially perpendicular to and extending from said base edge along a transverse line to a central hole, and a second straight fold line on one side of the line and extending between top edge and the hole and making a predetermined obtuse angle with the top edge. The top edge is interrupted by a notch in communication with the hole and defined in part by a first edge extending between the top edge and the hole and forming an obtuse angle with the top edge similar to that formed by the second fold line. The notch is further defined by a second edge confronting the first edge and between the second fold line and the first edge.

The blank is foldable along the first and second fold lines into a substantially flat condition with the first edge substantially coinciding with the second fold line, and with material of the blank adjacent the first edge confronting and overlapping material of the blank located between the second fold line and the second edge. The confronting material is affixable to itself, as by cement (or simply by angle, position and friction), to complete the fabrication of the shoulder guard from the blank.

The blank is disclosed as also having a third fold line extending from the hole toward the top edge and between the second fold line and the second edge, the second edge and the third fold line providing a panel straddling the transverse line when the blank is in flat condition.

The blank also has a configuration affording enhanced support for the shoulders of a garment hanging thereon.

The manner in which the invention attains the stated objects and advantages will become more apparent.

DESCRIPTION OF THE INVENTION

Figure 1:
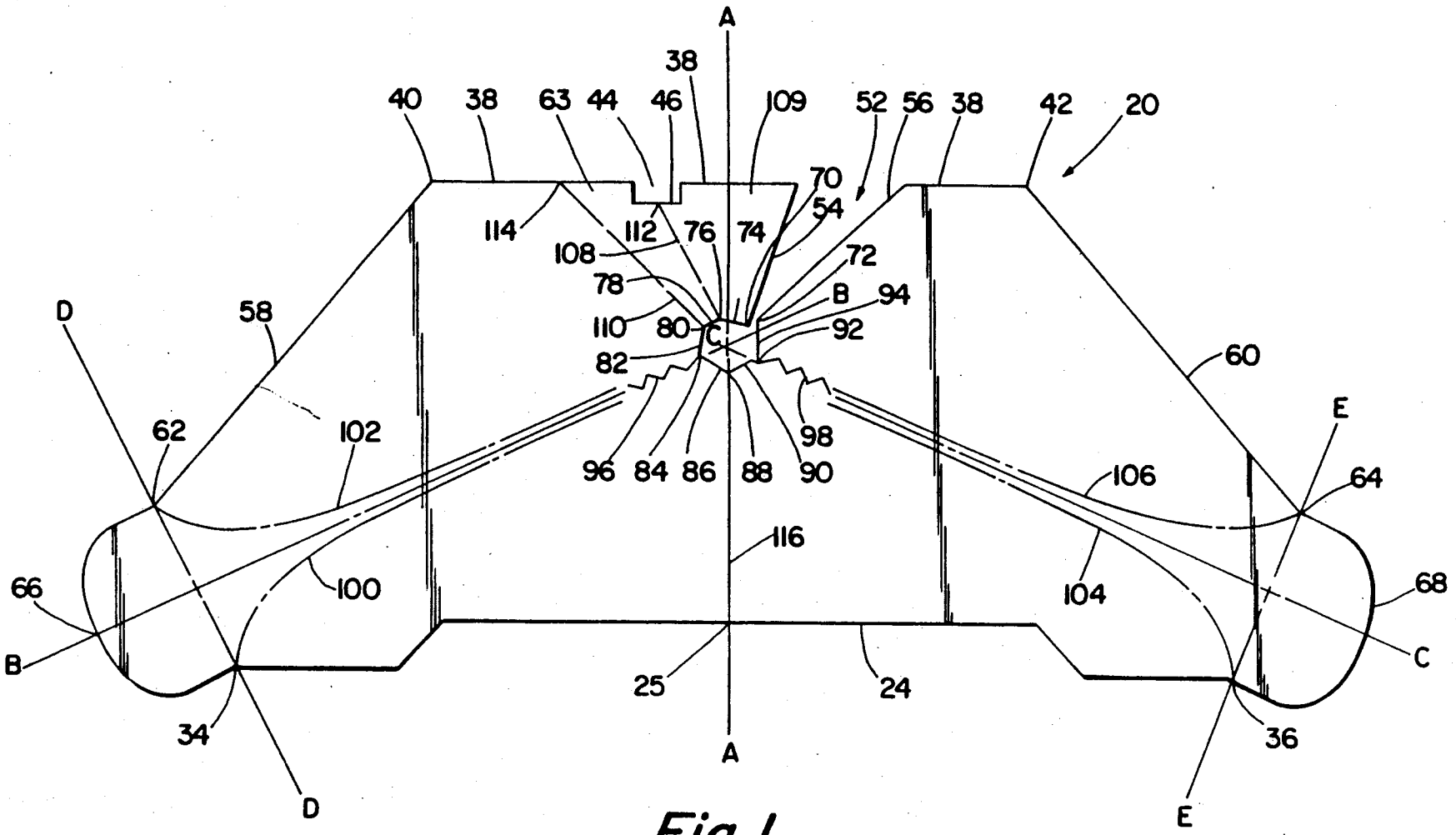
FIG. 1 is a plan view of a preferred blank embodying the invention from which a preferred garment hanger shoulder guard embodying the invention can be made.
Figure 4:
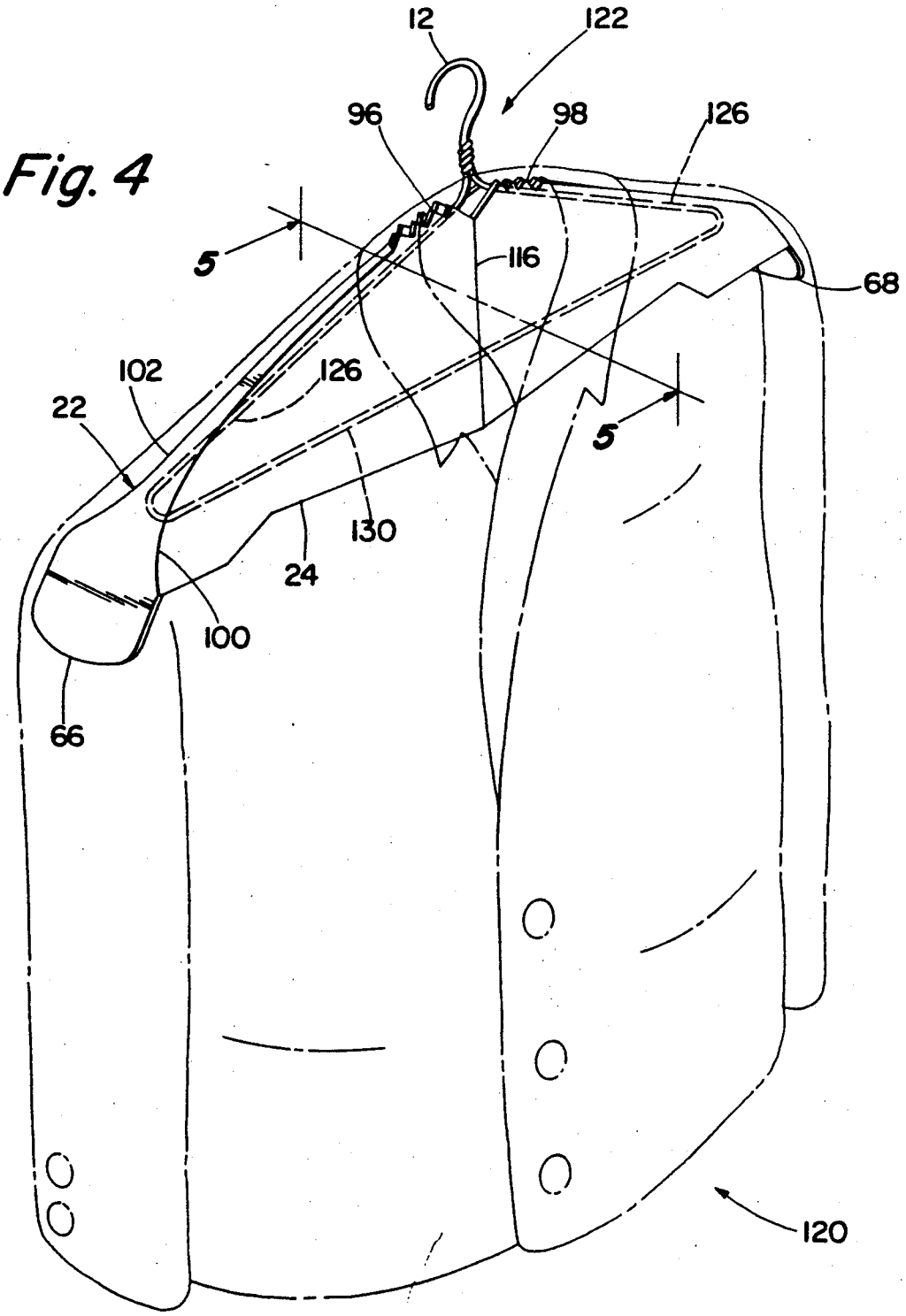
FIG. 4 is a perspective view of an assembly of the jacket (shown in phantom), the garment hanger and interposed therebetween, the preferred embodiment of the garment hanger shoulder guard made from the blank shown in FIGS. 1 and 2.
Figure 5:
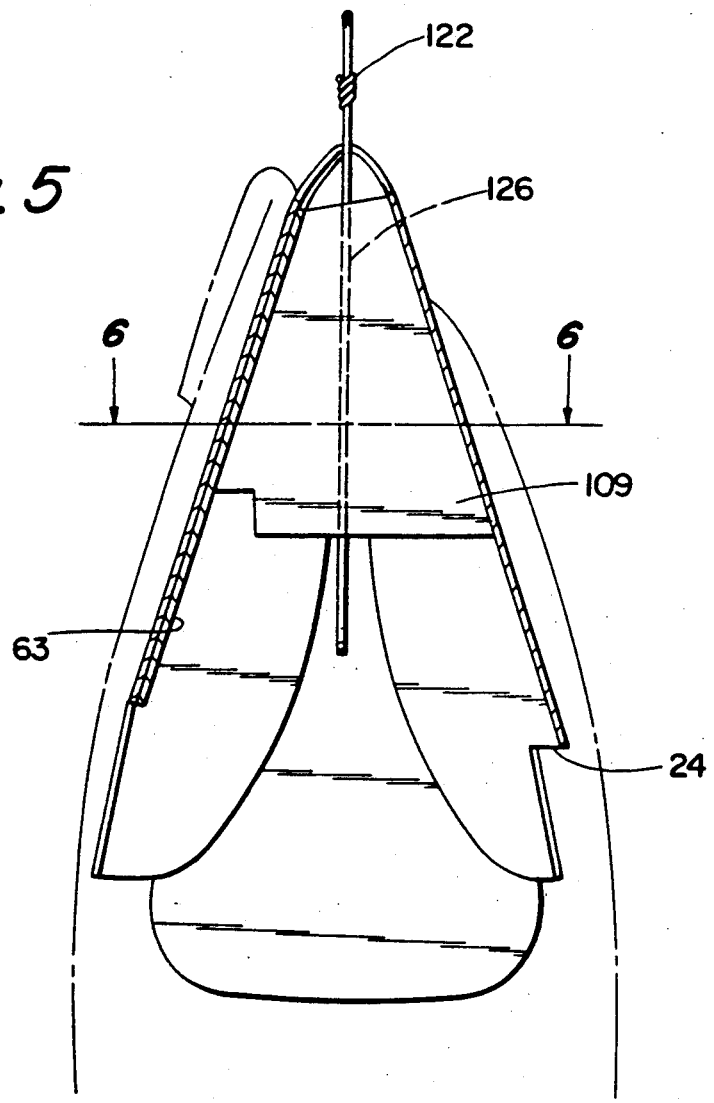
FIG. 5 is a side sectional view taken on line 5—5 of FIG. 4.
Figure 6:
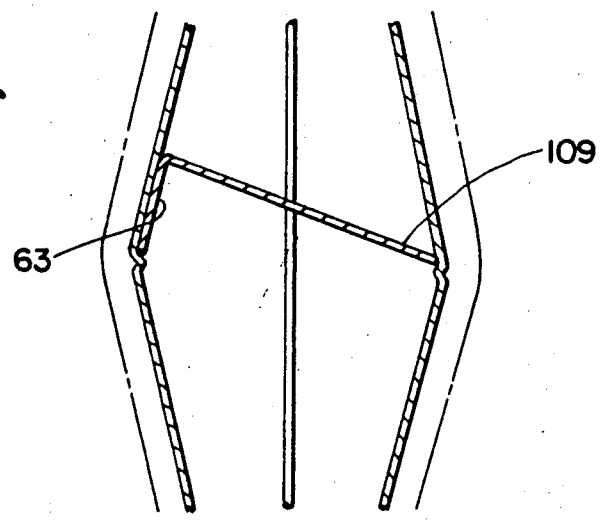
FIG. 6 is a top sectional view taken on line 6—6 of FIG. 5.

FIG. 1 shows one embodiment of the invention as a blank 20 in flat plan view from which a shoulder guard 22 embodying the invention can be made; guard 22 being shown in FIGS. 4, 5 and 6.

Blank 20 can be fabricated from a piece of card stock, or other suitable materials known in the art, and will be described in large part with respect to a transverse line A—A which is substantially in the center of blank 20. A base edge 24 is shown substantially perpendicular to and intersecting with line A—A at a point 25. In the preferred embodiment illustrated, base edge 24 is about 18 inches long, and substantially bisected by line A—A.

Blank 20 further has a straight top edge 38 which is interrupted as described below, and which is substantially parallel to base edge 24 and spaced about 6.25 inches therefrom. Top edge 38 is substantially perpendicular to line A—A and about 9 inches long. Top edge 38 has an extreme lefthand end 40 and an extreme righthand end 42.

Top edge 38 is interrupted by a notch 44 about 0.25 inch deep and about 0.375 inch long. Notch 44 is used during the manufacturing procedure to increase the speed and economy of assembling the guard 22. The right and left edges of notch 44 are substantially parallel to line A—A.

Top edge 38 is also interrupted by a notch 52 of irregular shape, which will be described in detail hereinafter. Notch 52 is partially defined by confronting straight edges 54 and 56 which intersect top edge 38 about 5.5 inches and about 7.25 inches, respectively, from lefthand end 40 of top edge 38.

Depending from lefthand end 40 and righthand end 42 of top edge 38 are edges 58 and 60, respectively, each making in this embodiment an angle of about 130° with top edge 38 and an angle of about 50° with base edge 24 extended. Each of edges 58 and 60 is about 6 inches long. Edges 58 and 60 terminate at lower ends 62 and 64, respectively.

Lower end 62 of edge 58 is joined to outer end 34 of base edge 24 by an edge 66 and lower end 64 of edge 60 is joined to outer end 36 of base edge 24 by an edge 68. In this embodiment, edges 66 and 68 are convex lobes and are substantially equidistant to line A—A. Lower end 62 of edge 58 is spaced about 2.5 inches from outer end 34 of base edge 24 and lower end 64 of edge 60 is spaced about 2.5 inches from outer end 36 of base edge 24. Lobed edges 66 and 68 will be further described hereinafter. Lobed edges 66 and 68 provide opposite ends of blank 20 and guard 22.

Notch 52, as stated above, is partially defined by edges 54 and 56. Edge 54 makes an angle of about 70° with top edge 38 and is about 2.0 inches in length, terminating at a lower end 70 remote from top edge 38. Edge 56 makes an angle of about 140° with top edge 38 and is about 3 inches in length, terminating at a lower end 72 remote from top edge 38. Notch 52 further has an edge 74 extending from lower end 70 of edge 54 at an angle of about 98° with edge 54 about 0.5 inch to an end 76, an edge 78 extending from end 76 at an angle of about 215° with edge 74 about 0.25 inch to an end 80, an edge 82 extending from end 80 at an angle of about 233° with edge 78 about 0.5 inch to an end 84 and an edge 86 extending from end 84 at an angle of about 233° with edge 82 about 0.5 inch to an end 88 which is on line A—A and located about 3.5 inches from base edge 24. Also, edge 86 makes an angle of about 118° with line A—A. Notch 52 additionally has an edge 90 extending from end 88 at an angle of about 236° with edge 86 about 0.5 inch to an end 92, and finally an edge 94 extending at an angle of about 243° with edge 90 about 0.625 inch to lower end 72 of edge 56.

Lobed edge 66 is substantially symmetrical with respect to a line B—B through end 84 and making an angle of about 23° with base edge 24, and lobed edge 68 is substantially symmetrical with respect to a line C—C end 92 and making an angle of about 23° with base edge 24, lines B—B and C—C being on opposite sides of line A—A. Also, line B—B is substantially perpendicular to a line D—D joining ends 34 and 62 and line C—C is substantially perpendicular to a line E—E joining ends 36 and 64. Ends 34 and 62 are spaced apart about 2.5 inches as are ends 36 and 64, and lobed edges 66 and 68 extend about 1.5 inches beyond lines D—D and E—E, respectively.

Blank 20 also has zig-zag perforations 96 and 98 therethrough. Zig-zag perforation 96 extends about 1.125 inch along line B—B from end 84, while zig-zag perforation 98 extends about 1.125 inch along line C—C from end 92.

Several fold lines are provided in blank 20. Thus, a pair of fold lines 100 and 102 are associated with zig-zag perforation 96, while fold lines 104 and 106 are associated with zig-zag perforation 98. Fold lines 100 and 102 are substantially symmetrical with respect to line B—B and start approximately at the end of zig-zag perforation 96 remote from end 84 where they are spaced apart about 0.25 inch, i.e., about 0.125 inch from line B—B. Fold lines 100 and 102 gradually recede from each other as they approach lobed edge 66 and then smoothly flare apart and terminate at ends 34 and 62, respectively. Fold lines 104 and 106 are symmetrical with respect to line C—C and start approximately at the end of zig-zag perforation 98 remote from end 92 where they are spaced apart about 0.25 inch, i.e., about 0.125 inch from line C—C. Fold lines 104 and 106 gradually recede from each other as they approach lobed edge 68 and then smoothly flare apart and terminate at ends 36 and 64, respectively.

Blank 20 has two additional fold lines, namely, fold line 108 and fold line 110. Fold line 108 extends from end 76, i.e., the juncture of edges 74 and 78 of notch 52, at an angle of about 123° with respect to top edge 38, terminating at a point 112 which is approximately the midpoint of bottom edge 46 of notch 44 which is rectangular in this embodiment. Fold line 108 extended intersects top edge 38 extended at a location about 3.0 inches from lefthand end 40 of top edge 38. The 123° angle is the angle between fold line 108 and the portion of top edge 38 between lefthand end 40 thereof and notch 44. Blank 20 has a panel 109 between edge 54 and fold line 108. Panel 109 straddles line A—A and edge 54 is a free edge of panel 109. Fold line 110 extends from end 80, i.e., the juncture of edges 78 ad 82 of notch 52, at an angle of about 140° with respect to top edge 38, terminating at a point 114 on top edge 38 about 1.75 inches from lefthand end 40 thereof The 140° angle is the angle between fold line 110 and the portion of top edge 38 between lefthand end thereof and point 114. Fold line 110 is about 2.875 inches long, as is edge 56 of notch 52, and edge 56 and fold line 110 are similarly inclined with respect to top edge 38 and are substantially symmetrically disposed with respect to line A—A.

Finally, the portion of line A—A between point 25 on base edge 24 and end 88, i.e., the juncture of edges 86 and 90, is a fold line 116.

The manner of converting blank 20 to guard 22 is simple and can be cheaply performed in the factory or retail level and will now be described. Blank 20 is creased, but preferably is not bent back on itself, along lines 100, 102, 104 and 106 and reflattened to the condition shown in FIG. 1. Blank 20 is creased but preferably is not bent back on itself, along line 108 and again reflattened to the condition shown in FIG. 1. Then blank 20 is bent 180° along line 110. The area between lines 108 and 110 forms portion 63. Blank 20 is folded on itself along line 116, to bring line 56 into coincidence with line 110 and the area of blank 20 adjacent line 56 into overlapping engagement with portion 63 to which cement can be applied (not shown). When the cement sets to adhere those two areas together, the fabrication of guard 22 is complete. Cementing of the two areas together is convenient but unnecessary. It is merely essential that the two areas be held in overlapping condition. This could be accomplished in other ways known in the art, such as by stapling.

Guard 22 will lie in substantially flat condition folded on itself along line 116 and line 110 until needed for use when it can be extracted from a supply (not shown) of guards 22 which may be stacked in a container (not shown).

Figure 2:
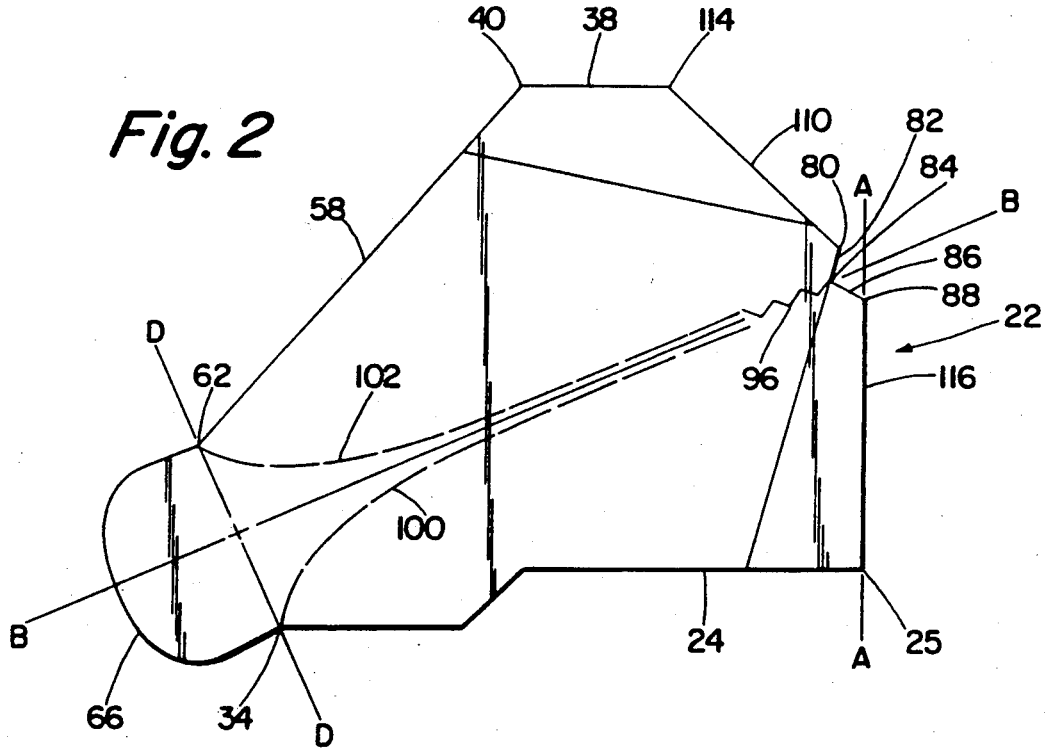
FIG. 2 is a plan view of one outside surface of the garment hanger shoulder guard made from the blank of FIG. 1, the guard being shown in flat condition, folded on itself.

FIG. 2 shows in plan view one outside surface of guard 22 which was made from blank 20 guard 22 being shown in flat condition, folded on itself along fold line 110 and fold line 116. The outside surface of guard 22 which is visible in FIG. 2 is the one which appears to the left of fold lines 110 and 116 in FIG. 1.

Figure 3:
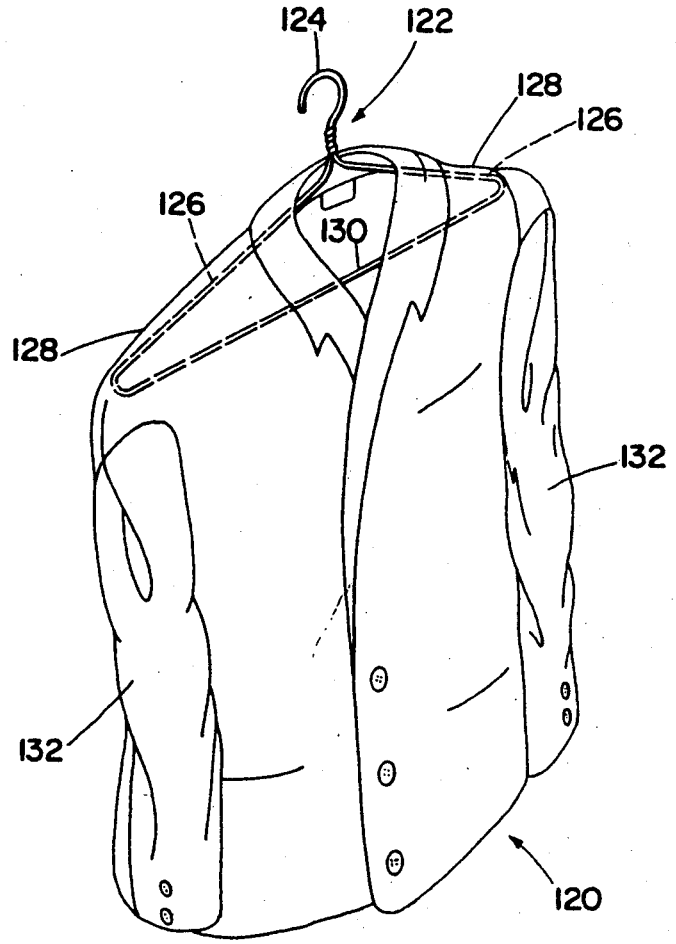
Fig. 3 (PRIOR ART)
FIG. 3 is a perspective view of a jacket hanging on a garment hanger with no shoulder guard.

FIG. 3 shows in perspective a jacket 120 hanging on a wire garment hanger 122 with no shoulder guard. As is typical, hanger 122 includes a hook 124, diagonal downwardly extending portions 126 which support shoulders 128 of jacket 120 and a bottom portion 130 joining the loWer ends of portions 126. It will be noted that jacket shoulders 128 are not well supported by portions 126 and are sharply creased thereover and that in consequence of the poor support of shoulders 128, jacket sleeves 132 are wrinkled. Some prior art garment shoulder guards do not materially improve upon the illustrated situation where there is no guard at all. This is primarily because these prior art garment shoulder guards do not support a large area of the shoulders of garments hung thereon.

Guard 22, in addition to being readily foldable, so as to be storable in flat condition, and in addition to not requiring a final assembly operation by an employee of a cleaning establishment, also is easily installed on hanger 122 and provides significantly improved support for a garment, such as jacket 120. Essentially, this installation involves merely unfolding guard 22 along line 116 and gently pulling lobed ends 66 and 68 of blank 20 apart. This causes guard 22 to pop up into an open condition in which it is installable on hanger 122. It is noted that this is accomplished by a partial flattening of blank 20 along fold line 116, which will also tend to flatten same along fold line 110 and move points 25 and 114 toward each other and open a central hole formed by edges 82, 86, 90 and 94, the hole being expansible by virtue of zig-zag perforations 96 and 98 to facilitate the passage of hook 124 of hanger 122 therethrough, in known fashion. Guard 22 can then be placed on hanger 122 as shown in FIGS. 6, 7 and 8. The guard is maintained in the installed condition, by the hanger 122 working against a certain springness in guard 22 which tends to return guard 22 toward its flat condition. Furthermore, when guard 22 is manipulated into its open (garment holding) condition, guard 22 will tend to flex along fold line 108 to cause edge 54 of panel 109 to engage fold line 116 on the internal side thereof, to provide a spreading force tending to limit the approach of fold lines 110 and 116 toward each other, i.e., the lateral narrowing of guard 22, under the weight of jacket 122. This feature is shown particularly in FIGS. 5 and 6, and assists in holding jacket 122 in the desired, wrinkle-free condition shown in FIG. 4.

It will be appreciated that the invention provides a garment hanger shoulder guard and blank therefor achieving the objects and advantages set forth above, as well as other objects and advantages.

The disclosed details are exemplary only and are not to be taken as limitations on the invention.

What is claimed is:

1. A card stock blank, which may be folded to become a garment hanger shoulder guard without the need for a slot and tab type closure, comprising a foldable material having a base edge and top edge parallel to one another, two side edges, a first fold line substantially perpendicular to and extending from the base edge along a transverse line to a central hole, a second fold line on one side of the transverse line and extending between the top edge and the central hole and making a predetermined angle with the top edge, the top edge interrupted by a notch in communication with the central hole and defined in part by a first edge extending between the top edge and the central hole, the notch being further defined by a second edge confronting the first edge and between the second fold line and the first edge, the side edges being on opposite sides of the transverse line and symmetrically disposed with respect to the central hole, the blank being foldable along the first fold line and along the second fold line into a flat condition with the first edge coinciding with the second fold line and with material of the blank adjacent to the first edge confronting and overlapping material of the blank located between the second fold line and the second straight edge.

2. A card stock blank of claim 1, wherein the predetermined angle formed by the second fold line and the top edge is an obtuse angle.

3. A card stock blank of claim 2, wherein the obtuse angle is about 140°.

4. A card stock blank of claim 1, which further comprises a third fold line extending from the central hole toward the top edge and between the second fold line and the second edge, the second edge and the third fold line providing a panel straddling the transverse line when the blank is in a flat condition.

5. A card stock blank of claim 1, wherein the side edges comprise lobes having two lobed edges which are symmetrically disposed with respect to the central hole, the blank being provided with a first pair of fold lines extending from the vicinity of the central hole toward the first lobed edge at an angle of divergence adjacent to the central hole and flaring outwardly at the first lobed edge, and a second pair of fold lines extending from the vicinity of the central hole toward the second lobed edge at an angle of divergence adjacent the central hole and flaring outwardly at the second lobed edge.

6. A card stock blank of claim 3, wherein the ends of each lobed edge are separated by a distance of about 2.375 inches.

7. A card stock blank of claim 5, wherein zig-zag perforations extend from the central hole toward the lobed edges and the first and second pairs of fold lines extend toward the lobed edges from the ends of the zig-zag perforations.

8. A shoulder guard made from a card stock blank which may be folded to become a garment hanger shoulder guard without the need for a slot and tab closure, comprising a foldable material having a base edge and top edges parallel to one another, two side edges, a first fold line substantially perpendicular to and extending from the base edge along a transverse line to a central hole, a second fold line on one side of the transverse line and extending between the top edge and the central hole and making a predetermined angle with the top edge, the top edge interrupted by a notch in communication with the central hole and defined in part by a first edge extending between the top edge and the central hole, the notch being further defined by a second edge confronting the first edge and between the second fold line and the first edge, the side edges being on opposite sides of a transverse line and symmetrically disposed with respect to the central hole, the blank being folded along the first fold line and along the second line into a flat condition with the first edge coinciding with the second fold line and with material of the blank adjacent to the first edge confronting and overlapping material of the blank located between the second fold line and the second straight edge.

9. A should guard of claim 8, wherein the material is affixed to itself by glue or cement at the area of the confronting and overlapping material.

10. A shoulder guard of claim 8, wherein the predetermined angle formed by the second fold line and the top edge is an obtuse angle of about 140°.

11. A shoulder guard of claim 10, wherein the material is affixed to itself by glue or cement at the area of the confronting and overlapping material.

12. A shoulder guard of claim 8, wherein the blank further comprises a third fold line extending from the central hole toward the top edge and between the second fold line and the second edge, the second edge and the third fold line providing a panel straddling the transverse line when the blank is in a flat condition, the material being affixed to itself in the area between the second and third fold lines, the second edge being a free edge and the panel being pivotable about the third fold line.

13. A shoulder guard of claim 12, wherein the material is affixed to itself by glue or cement.

* * * * *